US005916500A

United States Patent [19]

Fisher, Jr.

[11] Patent Number: 5,916,500

[45] Date of Patent: Jun. 29, 1999

[54] METHOD OF LINING A BLAST FURNACE

[75] Inventor: Frank M. Fisher, Jr., Glen Ellyn, Ill.

[73] Assignee: Magneco/Metrel, Inc., Addison, Ill.

[21] Appl. No.: 08/975,535

[22] Filed: Nov. 20, 1997

[51] Int. Cl.[6] ..... C21B 7/06; F27D 1/16

[52] U.S. Cl. ..... 264/30; 264/32; 264/35; 266/281

[58] Field of Search ..... 264/30, 35, 36.15, 264/36.18, 36.2, 32; 266/281; 427/140, 142

[56] References Cited

U.S. PATENT DOCUMENTS

| | | |
|---|---|---|
| 1,552,064 | 9/1925 | Lake . |
| 1,643,425 | 9/1927 | Summey . |
| 1,656,312 | 1/1928 | Black . |
| 1,678,976 | 7/1928 | Durfee . |
| 1,703,519 | 2/1929 | Dovel . |
| 1,710,931 | 4/1929 | Klein . |
| 2,301,101 | 11/1942 | Welshans . |
| 3,259,672 | 7/1966 | Oswald et al. . |
| 3,396,961 | 8/1968 | Farrington . |
| 3,477,682 | 11/1969 | Shupe . |
| 3,492,383 | 1/1970 | Heimgartner . |
| 3,672,649 | 6/1972 | Allen . |
| 3,703,348 | 11/1972 | Pivar . |
| 3,743,187 | 7/1973 | Breunsbach . |
| 3,832,097 | 8/1974 | Schlect . |
| 3,885,016 | 5/1975 | Pivar . |
| 3,916,047 | 10/1975 | Niesen . |
| 4,078,292 | 3/1978 | Porter . |
| 4,279,844 | 7/1981 | Danjyo et al. . |
| 4,364,798 | 12/1982 | Costa . |
| 4,381,856 | 5/1983 | Inoue et al. . |
| 4,438,906 | 3/1984 | English . |
| 4,442,050 | 4/1984 | Takuo . |
| 4,469,309 | 9/1984 | Takashima et al. . |
| 4,480,820 | 11/1984 | Zhukov et al. . |
| 5,147,830 | 9/1992 | Banerjee et al. . |
| 5,482,248 | 1/1996 | Connors, Jr. . |
| 5,505,893 | 4/1996 | Connors, Jr. . |
| 5,511,762 | 4/1996 | Connors, Jr. et al. . |
| 5,795,508 | 8/1998 | Soofi et al. . |

FOREIGN PATENT DOCUMENTS

| | | |
|---|---|---|
| 116722 | 7/1942 | Australia . |
| 0 009 021 | 3/1980 | European Pat. Off. . |
| 0 064 863 | 11/1982 | European Pat. Off. . |
| 0 505 141 | 3/1992 | European Pat. Off. . |
| 24 35 532 | 2/1976 | Germany . |
| 25 12 841 | 9/1976 | Germany . |
| 26 59 205 | 7/1977 | Germany . |
| 44-9646 | 5/1969 | Japan . |
| 77-029079 | 10/1978 | Japan . |
| 57-72758 | 5/1982 | Japan . |
| 84-259465 | 9/1984 | Japan . |
| 85-167843 | 5/1985 | Japan . |
| 85-214296 | 7/1985 | Japan . |
| 63-154258 | 12/1988 | Japan . |
| 307172 | 10/1982 | U.S.S.R. . |
| 1 415 431 | 11/1975 | United Kingdom . |
| 1 513 210 | 6/1978 | United Kingdom . |
| 2 105 828 | 3/1993 | United Kingdom . |
| WO 85/02397 | 6/1985 | WIPO . |

OTHER PUBLICATIONS

European Search Report Dated (Jan. 15, 1996).

Spec—Data: Stay–in–Place Form For Concrete FormWork, Alabama Metal Industries Corp. (AMICO) (Feb., 1989).

*Primary Examiner*—Karen Aftergut

*Attorney, Agent, or Firm*—Brinks Hofer Gilson & Lione

[57] ABSTRACT

A method is provided for installing a refractory lining in a blast furnace or other metallurgical vessel. A consumable form is installed along an inner surface of an outer shell of the metallurgical vessel. The consumable form is spaced apart from the outer shell. The metallurgical vessel is then filled with burden, which supports the consumable form. Casting composition may then be inserted between the consumable form and the outer shell. The casting composition is heated for a period of time before the burden is ignited. Cables which are lowered from the top of the vessel and secured at a lower end of the vessel may be used. Tubes mounted on panels may be threaded along the cables to position the panels in constructing the consumable form.

20 Claims, 3 Drawing Sheets

METHOD OF LINING A BLAST FURNACE

FIELD OF THE INVENTION

This invention relates to a method and structure for lining blast furnace metallurgical vessels including blast furnaces, with a refractory lining.

BACKGROUND OF THE INVENTION

Blast furnaces are used in the iron and steel industry for the production of pig iron which is later converted into steel and/or cast into a suitable form. The blast furnaces typically have refractory linings which protect their steel walls from oxidation, corrosion and erosion which would otherwise result from exposure to molten metal in the blast furnace. However, the refractory linings themselves experience wear and tear from exposure to the molten metal, and periodically have to be repaired or replaced.

The lining, or relining, of blast furnace interiors with a refractory material has conventionally been a time-consuming, labor-intensive, and relatively expensive process. Conventional lining methods have involved the use of preformed refractory bricks of predetermined size and shape which are adapted to conform to the contour of the blast furnace walls when the bricks are assembled together and stacked inside the blast furnace. The bricklaying methods have evolved into a complex science involving the selection of bricks of different sizes, shapes and compositions, for different regions in a blast furnace, and for different blast furnaces. Once the proper refractory bricks have been selected and formed, the bricks are laid side-by-side, and stacked vertically, in the blast furnace, and the joints between the bricks are filled with a refractory grout or slurry which then hardens and holds the bricks together.

U.S. Pat. No. 3,672,649, issued to Allen, describes a departure from the use of conventional bricks. A plurality of molding rings are installed, in sequence, in the blast furnace at a selected distance from the blast furnace steel wall. After the first ring is installed, a refractory lining material is manually poured between the steel wall and the molding ring, or is gunned into place. Then, a molding ring is placed at the next higher level in the blast furnace, and the above process is repeated until a monolithic refractory lining completely covers the desired region inside the blast furnace.

Unfortunately, manual pouring and gunning are also very labor-intensive and require much time to complete. Although a monolithic refractory lining is ultimately formed, it would be desirable to eliminate the need for preformed refractory bricks and the number of stages required to complete the manual pouring or gunning process. In the above-identified U.S. Pat. No. 3,672,649, no less than ten stages (represented by ten stacked molding rings) are shown in the drawings to form only a part of the desired monolithic refractory lining. As a result, the use of refractory bricks is still common notwithstanding the availability of this alternative process.

SUMMARY OF THE INVENTION

One aspect of the invention provides a method of installing a refractory lining in the metallurgical vessel. A metallurgical vessel including an outer shell is provided. A consumable form is installed along and spaced apart from an inner surface of the outer shell. The metallurgical vessel is then filled with burden. The consumable form is supported by the burden. A casting composition is then inserted between the consumable form and the outer shell to form the refractory lining.

The consumable form may comprise a plurality of standard concrete construction forms. The outer shell may preferably include a plurality of grout holes. A spacer rod having a specified length may then be inserted through the grout holes to allow proper spacing between the consumable form and the inner side of the outer shell. The spacer rod may alternatively include a hook at one end to interface with the form. The method may further comprise heating the casting composition at between about 250° F. to 750° F. for a period of time, which for a 40 ft. stack, for example, may be about 24 to 36 hours. Prior to heating, the casting composition may preferably be air cured for a period of time between about 12 to 24 hours. The consumable form is preferably installed by first installing a first wall of panels at the lowest elevation to be repaired, and next installing a second wall of panels on top of the first wall of panels. This stacking process is continued until the consumable form is complete. Each wall of panels may be preferably at least about 6 ft. The panels may be lowered from a top portion of the furnace. The panels may include at least one tube having a male and a female end. A cable may be threaded through the tube and the panels lowered down to the desired elevation. Preferably, the casting composition is continuously pumped between the form and the inner side of the outer wall.

Another aspect of the invention provides for a method of installing a refractory lining in a blast furnace. A blast furnace including an outer shell is provided. An annular support plate is inserted against an inner surface of the outer shell and near a tuyere section of the blast furnace. A first elevation of panels is secured to the plate. The panels are spaced apart from an inner side of the outer shell. A second elevation of panels is then secured to the first elevation of panels. The blast furnace is then filled with burden. An inner surface of the panels is supported with the burden. A casting composition may then be pumped between the panels and the inner surface of the outer wall to form the refractory lining.

Another aspect of the invention provides for a method of installing a refractory lining in a blast furnace. A blast furnace including an outer shell and a tuyere section is provided. A plurality of panels with each panel including at least one tube attached thereto is also provided. A steel cable is inserted into the blast furnace from a top portion of the blast furnace. The cable is lowered to allow a lower end of the cable to be secured at the tuyere section. A top end of the cable is inserted through the tube on the panel. The panel is then lowered into a desired position along the cable. A spacer rod is inserted through a grout opening in the outer shell to space the panel from the outer shell. The cable is then tightened to remove slack and pull the panels toward the outer shell. The blast furnace is then filled with burden. A casting composition is then inserted between the panels and the outer shell.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
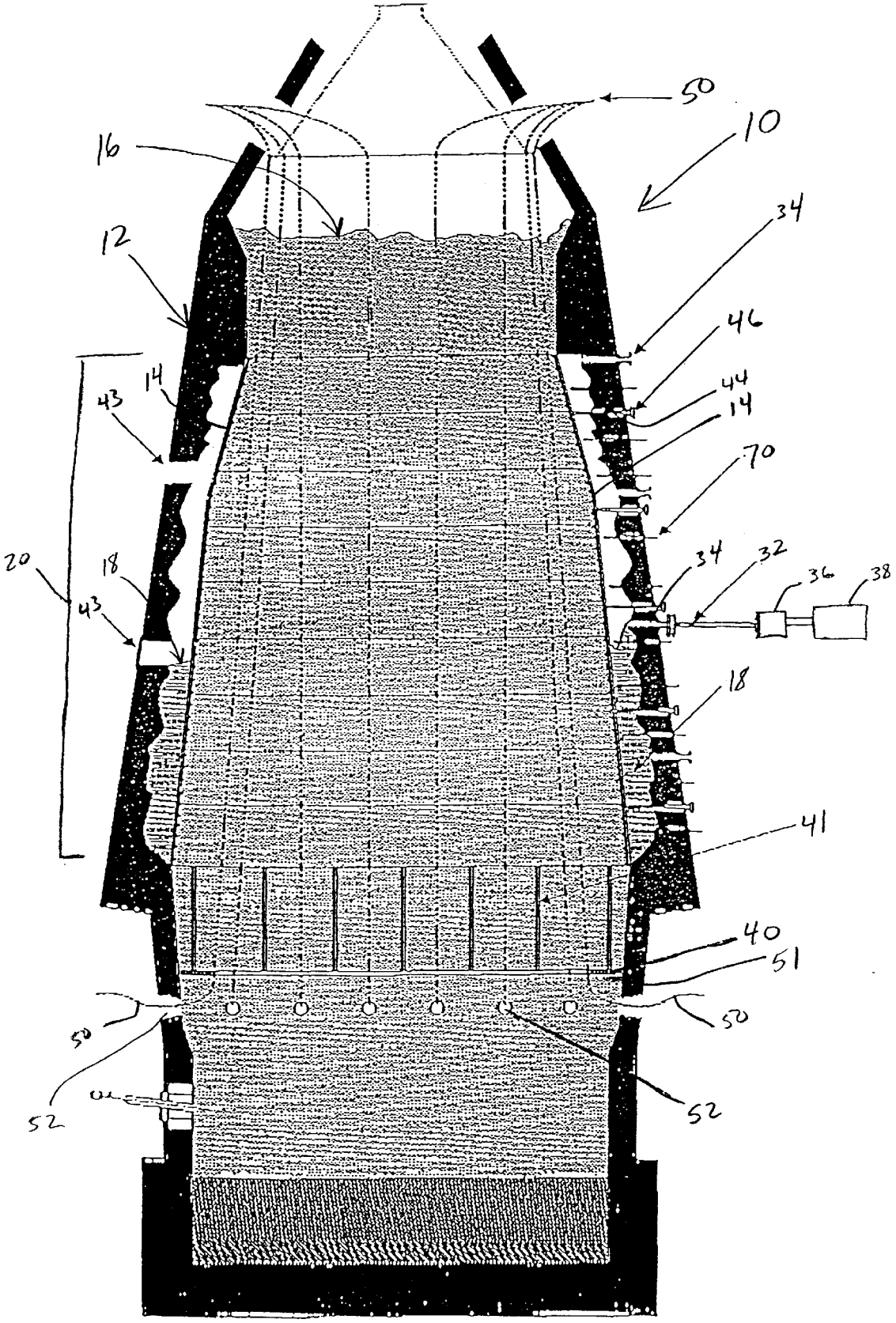
FIG. 1 is a sectional schematic view of a blast furnace during the formation of a refractory lining according to the method of the invention.

Referring to FIG. 1, the method of installing a refractory lining provides a metallurgical vessel 10, which includes, for example, the blast furnace shown. The metallurgical vessel 10 has an outer shell 12. A consumable form 14 is installed along an inner surface of the outer shell 12, and spaced apart from the outer shell 12. The metallurgical vessel 10 is filled with burden 16 (raw materials for the blast furnace including coke, iron ore, and limestone), which acts to support the consumable form 14. A casting composition 18 may then be inserted between the consumable form and inner surface of the outer shell 12.

While the method of the invention can be used to line any portion of the metallurgical vessel 10, the invention is illustrated in FIG. 1 with reference to the stack portion 20 of the blast furnace.

Figure 3:
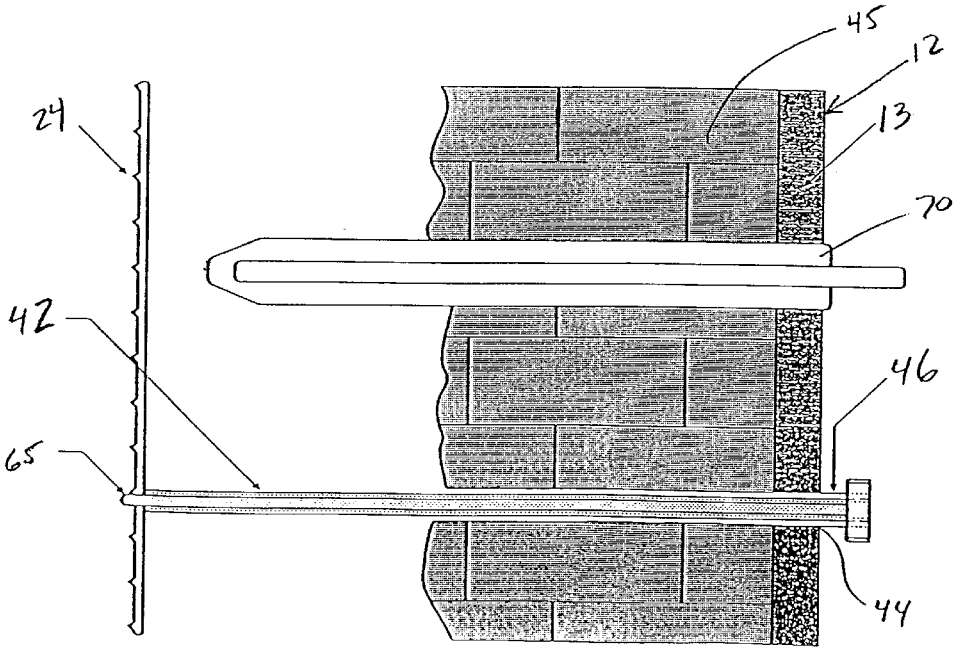
FIG. 3 is a sectional schematic view of a blast furnace wall with a preferred embodiment of a consumable form and spacer rod assembled in accordance with the invention.

After the blast furnace is blown down, which may take, for example, 48 hours, the hearth and stack begin cooling. Furnace temperature and gas levels must be low enough for laborers to enter furnace. Stack walls may then be cleaned with hydro-blasting or some other mechanical means. As shown in FIG. 3, the outer shell 12 may include steel shell 13, and in some instances a portion of the existing refractory wall 45.

Initially, a layer of refractory insulating board as shown in U.S. Application Ser. No. 08/650,221, U.S. Pat. No. 5,795,508, may be mounted against the outer shell 12 in the first (lowest) stage of the stack 20. The insulating board layer is optional but may be preferred for some applications, because it helps contain the heat inside the blast furnace. The insulating board layer may not be needed in situations where the main refractory lining to be formed is thick enough, or possesses sufficient insulating properties, to overcome the need for a separate insulating board layer.

Figure 2:
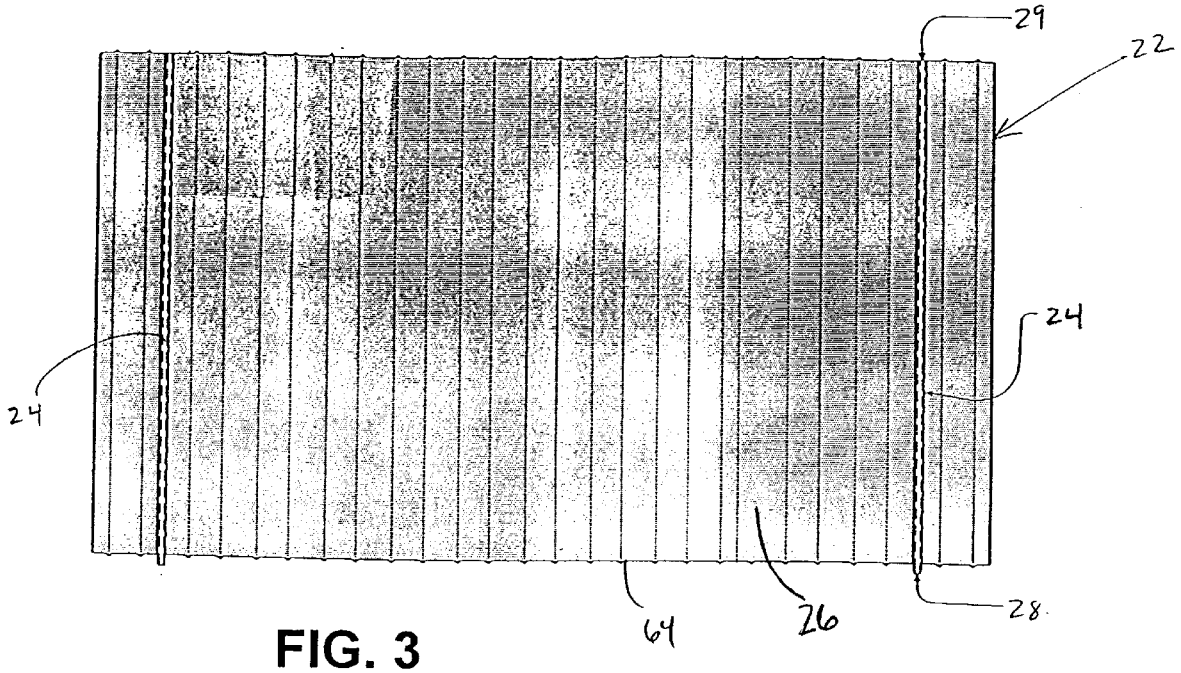
FIG. 2 is a front view of a preferred embodiment of a panel made in accordance with the invention.

The consumable form 14 may preferably be constructed of a plurality of consumable panels 22. The panels 22 are preferably made of metal, for example, galvanized steel, and of a modular design, which is both lightweight and porous. The panels 22 may be constructed in situ in the blast furnace, or can be constructed externally and inserted into the blast furnace. Platforms, cables, and elevators may be temporarily provided in the blast furnace, as needed, to facilitate construction and/or installation of the panels 22. Access to the blast furnace is available through one or more access doors 43. In a preferred embodiment shown in FIGS. 2 and 3, the panels 22 includes at least one metal tube 24 attached to a porous panel portion 26. The metal tube 24 may be positioned at or near the ends of the porous panel portion 26, and help to reinforce the panel. Preferably, the metal tube 24 includes a male end 28 and a female end 29, which allows each panel to mate with the panel positioned on top of it. Other alternative panels or forms, including standard concrete construction forms, manufactured by Form Tech Concrete Forms, Euclid, Ohio mart be used.

The panels 22 should be constructed and installed so that there is a space corresponding to the thickness of the refractory lining to be formed, between the outer surface of the consumable form 14 and the inner surface of the outer shell 12 (if no insulating boards are used). Preferably, this installation process uses modular and lightweight consumable forms or panels 22 to construct the perimeter walls of a furnace. The panels 22 will be installed and secured to each other to create a continuous wall. Once the panels 22 have been installed to create the consumable form 14, the inside volume of the blast furnace, which is inward of the consumable form 14 will be filled with the burden 16. The burden 16 will provide the primary support for the panels 22 and prevent collapse during the pumping process. For a 30 ft. diameter blast furnace, the burden fill may take, for example, 24 hours to complete. The refractory will then be pumped between the consumable form 14 and the outer shell 12. For the above-sized blast furnace, the pumping process may take, for example, approximately 24 hours and the refractory may then air cure for between about, for example, 12 to 24 hours. Once the refractory has set, controlled heating of the refractory may begin. Controlled heating from 250° F. to 750° F. may require, for example, 24 to 36 hours, after which the furnace can begin start-up procedures. As the furnace is brought on-line, the burden 16 will ignite at approximately 1000° F. and consume the consumable form 14.

As shown in FIG. 1, the casting composition 18 may be injected using refractory pumping hose 32 inserted through pumping openings 34 connected to a pump 36, from a source 38 to the space between the consumable form 14 and the outer shell 12. The casting composition 18 may be installed using a concrete pump or similar pump as described in U.S. Pat. No. 5,147,830. One example of a useful concrete pump is the Thom-Kat TVS16-2065, available from Pultzmeister, Inc., Thomsen Div., Gardena, Calif. 90248. Such a concrete pump is described in U.S. Patent No. 3,382,907, and in German Patent No. 2,162,406, the disclosures of which are incorporated herein by reference. Other commercially available concrete pumps, and other suitable pumps, may also be used to transport the casting composition 18. One presently preferred pump is the Putzmeister pump, available from Original Concrete, located in Bensenville, Ill.

Suitable pumpable refractory casting compositions are disclosed in U.S. Pat. No. 5,147,830, the contents of which are incorporated herein by reference. Generally, these pumpable compositions include about 55–90% by weight of a granular refractory base material selected from calcined clay, mullite, brown fused alumina, tabular alumina and mixtures thereof; about 8–14% by weight liquid carrier, which later serves as a binder after drying, including a dispersion of about 15–70% by weight colloidal silica in water; optionally, about 5–20% by weight calcined alumina and/or 1–35% by weight silicon carbide; and, preferably, about 0.2–1.0% by weight of a setting agent such as calcium aluminate cement or magnesium oxide, and about 1–10% by weight microsilica.

In a preferred embodiment, shown in FIG. 1, an annular support plate 40 may preferably be assembled on an inner surface of the blast furnace, for example, near the tuyere level 51 to support the consumable form 14. A plurality of angle supports 41 may connect to the support plate 40. Workers may enter and exit the blast furnace, through access windows 43. The prefabricated panels 22 may then be secured to the angle supports 41 and attached to each other to form, for example, six foot high walls around the inside perimeter of the furnace. Alternatively, the panels 22 may be attached directly to the support plate 40 and the panels 22 may first be constructed around the bosh section of the furnace. Specially designed spacer rods 42, preferably made of, for example, ceramic or steel are inserted into the furnace through pre-drilled or existing grout holes 44 and will hold the panels 22 in the correct position ensuring specified refractory thickness. As each elevation of panels 22 is secured, the next set is placed on top. Panels 22 may, for example, be bolted, welded or pinned together or connected by any other secure means.

Once the entire repair area is formed, pumping of the casting composition 18 may begin. Mixing and pumping equipment may preferably be staged at or near the highest repair elevation to facilitate pumping. The casting composition 18 is preferably delivered through refractory pumping hose 32. Nipples 46 may be welded to the shell 12 of the furnace prior to outage. Access holes 44 may be cut through the existing refractory lining 45 while the interior of the furnace is being cooled. Casting composition 18 is preferably continuously pumped into the furnace. Preferably, the pumping hose 32 is positioned at an elevation not more than ten feet above material level.

In order to further expedite the repair technique, the panels 22 may be set from the exterior of the furnace. This technique requires steel cables 50 to be strung from the top of the furnace down through tuyere openings 52. The metal tubes attached to each panel 22 of the consumable form 14 will both support the panel 22 and act as eyelets to thread panels 22 down the cables 50 into position. The male and female ends 28, 29 of the tubes interlock in tent pole fashion.

Figure 4:
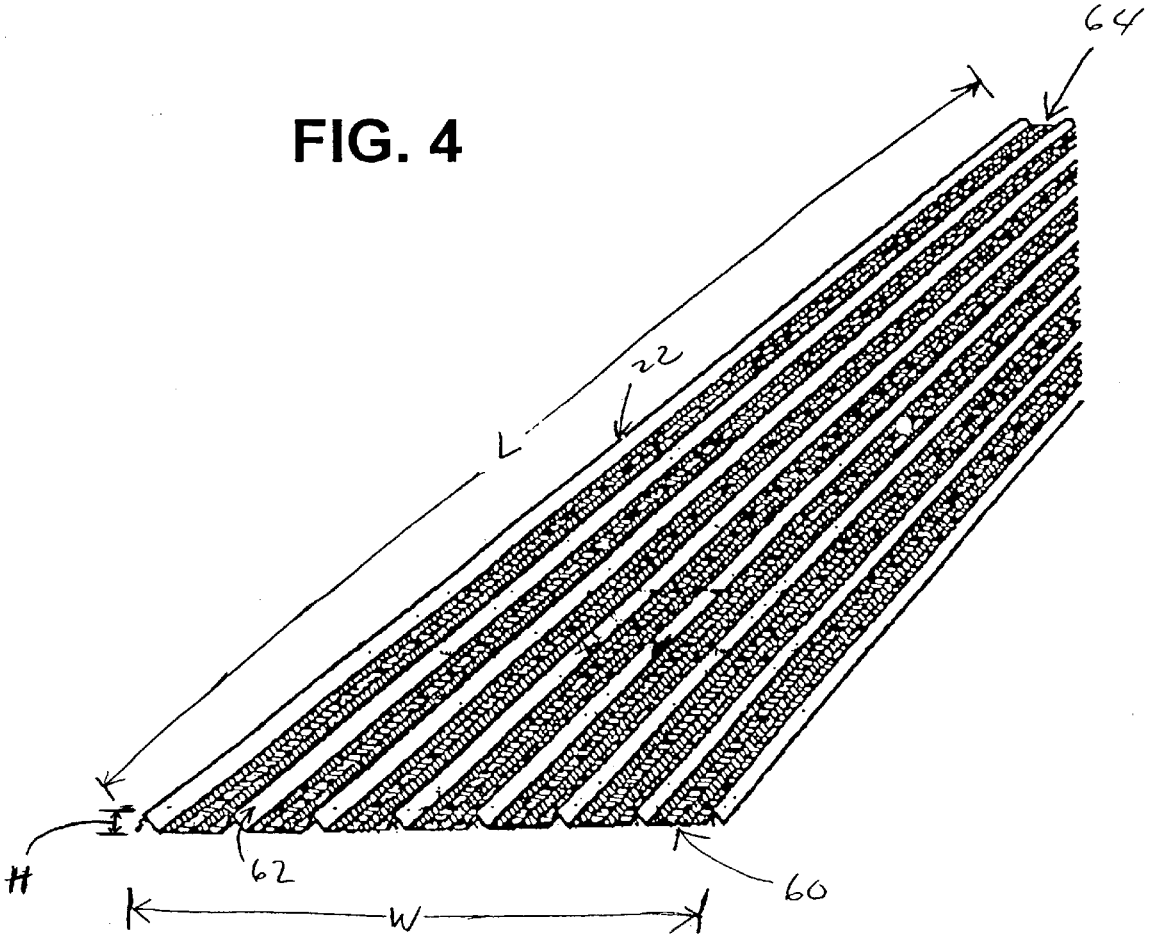
FIG. 4 is a perspective view of a preferred embodiment of a portion of a panel.

As shown in FIG. 4, the bottom horizontal edge 60 of each panel 22 preferably has a plurality, an inverted split "Y" ribs 62, which mate with the top edge 64 of the panel placed above it. The top edge 64 will preferably be lined with fiber to seat inside the inverted "Y" rib 62. As shown in FIG. 4, one preferred panel, available from STAY-FORM™ (standard grade no. 66, product code 30263), has a length (L) of 97±½ inches, a width (W) of 27±⅛ inches, and a plurality of longitudinally oriented ribs 62 having a height (H) of ¾ inch and spaced 3⅛ inches from the rib centers. This STAY-FORM™ panel is made of hot dipped galvanized sheet steel per ASTM-AS25. Panels 22 preferably may be staggered horizontally with an overlap to prevent material seepage. Once all panels 22 are in place, the support cables 50 may be tightened to remove slack and to pull panels 22 in towards furnace shell 12. The spacer rods 42 that have been inserted through grout holes 44 act as spacers to define the desired wall thickness. Each spacer rod 42 may include a hook 65 or other clamping, securing, or fastening means on the end to secure the panel 22 to the spacer rod 42. After the pumpable material has cured, the spacer rod 42 may be removed and refilled with the casting composition 18. Once panels 22 and cables 50 are secured, the burden 16 may be charged into the furnace to act as support for the consumable form 14.

One significant advantage of using a pumpable casting composition is that only the refractory pumping hose 32 need to be raised, while the pump 36 and source 38 remain conveniently outside of the blast furnace 10. The refractory pumping hose 32 may be conveniently inserted into the blast furnace 10 through openings 34 formed in the outer shell 12.

The use of the porous consumable form 14 supported by the burden 16 facilitates the forming, drying and hardening of the casting composition 18. Copper cooling plates 70 remove heat from the refractory lining. The use of a pumpable casting composition 18 eliminates the need for a labor-intensive gunning or pouring operation. These factors, in combination, greatly simplify the formation of the refractory liner. Unlike the prior art, the process disclosed herein is not limited by a man manually laying refractory bricks, or by the gunning process.

The inward lateral or head pressure exerted by the wet casting composition on each respective panel 22 may be a limiting factor on the flow rate of the pumpable casting composition. For example, to repair a 40 foot stack, the flow rate of the casting composition 18 may be, for example, about 2 linear ft./hr. The pumping time would accordingly take 20 hours. The flow rate must remain at a level to allow sufficient time for the casting composition to harden, thus reducing the lateral or head pressure as the wet casting composition is continuously pumped. Preferably, for example, less than approximately 8 linear ft. of casting composition may be in the wet state during the continuous pumping process.

While the embodiments of the invention disclosed herein are presently considered to be preferred, various modifications and improvements can be made without departing from the spirit and scope of the invention. The scope of the invention is indicated in the appended claims, and all charges that fall within the meaning and range of equivalents are intended to be embraced therein.

I claim:

1. A method of installing a refractory lining in a metallurgical vessel comprising:

providing a metallurgical vessel including an outer shell;

installing a consumable form along an inner surface of the outer shell, the consumable form is spaced apart from the inner surface of the outer shell;

filling the metallurgical vessel with burden;

supporting the consumable form with the burden; and inserting a casting composition between the consumable form and the outer shell to form the refractory lining.

2. The method of claim 1, wherein the consumable form comprises a plurality of standard concrete construction forms.

3. The method of claim 1, wherein the outer shell includes a plurality of grout holes, inserting a spacer rod having a specified length through each of the grout holes to allow proper spacing between the consumable form and the inner surface of the outer shell.

4. The method of claim 3, wherein each spacer rod includes a hook at one end of the spacer rod for interfacing with the consumable form.

5. The method of claim 1, further comprising heating the casting composition.

6. The method of claim 5, further comprising heating the casting composition at between about 250° F. to 750° F. for a period of time.

7. The method of claim 6, wherein the period of time is between about 24 to 36 hours.

8. The method of claim 1, further comprising allowing the casting composition to air cure for a period of time.

9. The method of claim 8, further comprising heating the casting composition after the casting composition is allowed to air cure between about 12 to 24 hours.

10. The method of claim 1, wherein the consumable form is first installed by first installing a first wall of panels at a lowest elevation in the metallurgical vessel and next installing a second wall of panels on top of the first wall of panels.

11. The method of claim 10, wherein each wall has a height of at least about 6 feet.

12. The method of claim 10, wherein each panel is lowered from a top portion of the metallurgical vessel.

13. The method of claim 12, wherein each panel includes at least one steel tube attached to the panel for connecting the panels.

14. The method of claim 13, wherein each tube has a male and female end, connecting the male end of a first tube which is connected to a first panel with the female end of a second tube which is connected to a second panel.

15. The method of claim 13, further comprising threading a cable through the tube, lowering the panel into position along the cable.

16. The method of claim 13, wherein a first panel includes a bottom horizontal edge having a surface which mates with a top horizontal edge of a second panel positioned below the first panel.

17. The method of claim 1, wherein the casting composition is pumped between the consumable form and inner side of the outer wall.

18. The method of claim 1, wherein the metallurgical vessel comprises a blast furnace.

19. A method of installing a refractory lining in a blast furnace comprising:

providing a blast furnace including an outer shell;

inserting an annular support plate against an inner surface of the blast furnace;

securing a first elevation of panels to the plate, the panels spaced apart from an inner surface of the outer shell;

securing a second elevation of panels to the first elevation of panels;

filling the blast furnace with burden;

supporting an inner surface of the panels with the burden; and pumping a casting composition between the panels and inner surface of the outer wall to form the refractory lining.

20. A method of installing a refractory lining in a blast furnace comprising:

providing a blast furnace including an outer shell, and a plurality of tuyere openings formed through the outer shell;

providing a plurality of panels, each panel including a tube attached thereto;

inserting a steel cable into the blast furnace from a top portion of the blast furnace;

lowering the cable to allow a lower end of the cable to be secured at the tuyere openings;

inserting a top end of the cable through the tube on each panel;

lowering each panel into a desired position along the cable;

inserting a spacer rod through a grout opening of the blast furnace to space the panels from the outer shell;

tightening the cable to remove slack and pulling the panels toward the outer shell;

filling the blast furnace with burden; and inserting a casting composition between the panels and the outer shell to form the refractory lining.

* * * * *